US005866229A

United States Patent [19]

Gärtner et al.

[11] Patent Number: 5,866,229

[45] Date of Patent: Feb. 2, 1999

[54] TUFT BACKING

[75] Inventors: Rudolf Gärtner; Bernhard Klein, both of Birkenau; Ararad Emirze, Kaiserslautern; Christoph Josefiak, Rimbach, all of Germany

[73] Assignee: Firma Carl Freudenburg, Weinheim, Germany

[21] Appl. No.: 815,823

[22] Filed: Mar. 12, 1997

[30] Foreign Application Priority Data

Mar. 12, 1996 [DE] Germany ..... 196 09 586.7

[51] Int. Cl.[6] ..... B32B 5/12; D04B 23/08

[52] U.S. Cl. ..... 428/114; 428/95; 428/305; 428/319; 428/366; 428/367; 66/192

[58] Field of Search ..... 442/305, 319, 442/366, 367; 428/95, 114; 66/192

[56] References Cited

U.S. PATENT DOCUMENTS

| | | | |
|---|---|---|---|
| 3,816,231 | 6/1974 | Marshall | 442/366 |
| 4,450,196 | 5/1984 | Kamat | 428/197 |
| 4,472,086 | 9/1984 | Leach | 442/366 |
| 4,518,640 | 5/1985 | Wilkens | 66/192 |
| 4,615,934 | 10/1986 | Ellison | 442/313 |
| 4,722,203 | 2/1988 | Darjee | 66/202 |
| 5,194,320 | 3/1993 | Groshens | 442/319 |
| 5,424,110 | 6/1995 | Tornero et al. | 66/192 |

*Primary Examiner*—Terrel Morris
*Attorney, Agent, or Firm*—Kenyon & Kenyon

[57] ABSTRACT

A textile composite material is used as tuft backing for tufted carpets, the composite material having at least one non-woven fabric on which exclusively parallel-running, straight, load-absorbing, plastic, continuous filaments are rascheled, and a thin binding yarn serving as a knitting chain fixing the continuous filaments in position.

6 Claims, No Drawings

TUFT BACKING

BACKGROUND OF THE INVENTION

The invention relates to a backing for tufted carpets as are typically used in the living room and in the furnished area. According to DE-A1-39 41 189, such backings consist of a non-woven, spunbonded material of polyester and copolyester filaments which are irregularly joined and autogenously, thermally agglutinated during their formation and bonding. This document addresses the problem that high mechanical and thermal stresses occur when manufacturing and processing a tufted carpet which lead to unwanted deformations. These are, in particular, elongations in the lengthwise direction and shortenings in the transverse direction. There should also be great dimensional stability when laying or during ageing. This holds true in particular for backings or underlays having low weight equal to or below 150 g/m$^2$.

The manufacture of tuft backings is explained in DE-A-39 41 189 as well. For example, a molten, synthetic mass of polyester, in particular polyethylene terephthalate or polyethylene terephthalate/polybutylene terephthalate, is extruded in the form of continuous filaments or bicomponent filaments. These filaments are bonded by needling and thermobonding. Lightweight, spunbonded materials are formed of between 20 and 500 g/m$^2$, preferably under 150 g/m$^2$. At the same time, the titers of the filaments are about 7 dtex.

In the interest of stabilizing these spunbonded materials, for example, polyester filaments are applied in the lengthwise direction on one or both of their sides. These filaments run straight, parallel to one another and exist as continuous, high-modulus filaments. Understood under the last term is a modulus of elasticity over 20 GPa, at room temperature and at temperatures over 200° C., as well. The high-modulus filaments are secured to the formed fabric by means of special needling during or after the formation of the nonwoven fabric, starting from warp beams, with travelers or bobbins. The parallel-running, high-modulus filaments have titers of 0.28 to 27.2 dtex. Their distances from one another are 2 to 30 mm. It is suggested to apply such a quantity of filaments that, given stretching of the formed fabric in the lengthwise direction, a tearing is first determined from 80 daN/m width. Glass filaments are named as preferred high-modulus threads.

DE-U1-295 09 066 describes a textile composite material for stabilizing floors and ground [cover] layers and as a load-absorbing filtration layer. In this case, the composite material consists of a formed fabric of plastic fibers. To attain high resistance to tearing in the main load direction without excessive stretching, and to absorb great tensile forces, exclusively parallel-running, load-absorbing, straight, plastic, continuous filaments are rascheled on the nonwoven fabric. Due to this, the textile composite material of nonwoven fabric becomes highly tear-resistant in the main load direction. The plastic, continuous filaments counteract an application of force immediately, without having to be substantially stretched beforehand.

The load-absorbing threads are applied with a width on the non-woven fabric corresponding to the width of the formed-fabric web. Their cross-section lies in the range of 2 to 100 mm$^2$, their distance to one another is 1 to 100 mm. For example, polyester fibers form the base nonwoven fabric which contains the load-absorbing, parallel filaments rascheled on one or both of its sides. A thin binding yarn is guided as a knitting chain on the raschel machine and secures the load-absorbing, plastic, continuous filaments on the nonwoven fabric.

In one preferred specific embodiment, the load-absorbing filaments run warpwise and in the lengthwise direction of the nonwoven fabric web. Another variant is indicated in which, in each case, the load-absorbing filaments are rascheled in pairs on the nonwoven fabric, the distance to the thread pairs being 1 to 100 mm. In each case, polypropylene is specified as the preferred material for the nonwoven fabric, load-absorbing filaments and binding yarn.

DETAILED DESCRIPTION OF THE INVENTION

An object of the present invention is to make a tuft backing of spunbonded material resistant, especially with regard to shrinkage in width, to the effect of tension, temperature and moisture when dying, tufting and steaming during the manufacture and processing of a tufted carpet. In so doing, the use of glass filaments shall be avoided, because when tufting, destruction of these filaments always occurs because of their brittleness, and the reinforcing function is thereby canceled. In spite of the resistance called for, the formed fabric shall be able to be only 80 to 150 g/m$^2$ heavy.

This and other objects of the invention are fulfilled by the use of a textile composite material in accordance with DE-U1-295 09 066 as a tuft backing for tufted carpets, this composite material having the following characteristics. The composite material has at least one nonwoven fabric of polyester fibers, on which exclusively parallel-running, straight, load-absorbing, plastic, continuous filaments of polyester are rascheled. The term raschel is used herein to denote to knit with a raschel machine. The titer of these filaments is 500 to 1500 dtex, their distance to one another is 4 to 20 mm. The thin binding yarn serving as the knitting chain secures the reinforcing filaments to the formed fabric substrate.

In the interest of high dimensional stability, the thin binding yarn has a titer of 400 to 1100 dtex and a tenacity of at least 60 cN/tex.

The 80 to 150 g/m$^2$ heavy spunbonded material consists of spun, continuous filaments having titer values of 2 to 10 dtex, the filaments, running irregularly, being bonded to one another by thermobonding at their fiber intersections.

In one preferred exemplary embodiment of the invention, a textile composite material having the above characteristics is used in which, in each case, the load-absorbing filaments are rascheled in pairs on the nonwoven fabric, the distance between the respective pairs of filaments being 4 to 20 mm.

An advantage of the invention is that it makes it possible to manufacture extremely light-weight carpet backs for living room carpets which nevertheless withstand the mechanical and thermal stresses during manufacture and processing without significant transverse shrinkage, while avoiding reinforcing glass filaments.

What is claimed is:

1. A textile composite material which can be used as a tuft backing for tufted carpets, comprising:

at least one nonwoven fabric of polyester and copolyester fibers on which exclusively parallel-running, straight, load-absorbing, plastic, continuous filaments of polyester are rascheled, the load-absorbing filaments having a titer of 500 to 1500 dtex and being separated by a distance between the load-absorbing filaments of 4 to 20 mm; and a thin binding yarn serving as a knitting chain and having a titer of 400 to 1100 dtex and a tenacity of at least 60 cN/tex fixing the load-absorbing filaments to said nonwoven fabric;

wherein the nonwoven fabric is 80 to 150 g/m$^2$ heavy and comprises spun continuous filaments having titers of 2 to 10 dtex, and the spun continuous filaments, running irregularly, being secured to one another by thermobonding.

2. The textile composite material according to claim 1, wherein the load-absorbing filaments are knitted in pairs on the nonwoven fabric, and wherein the respective pairs of filaments are separated from each other by a distance of 4 to 20 mm.

3. The textile composite material according to claim 1 which excludes glass filaments.

4. The textile composite material according to claim 2 which excludes glass filaments.

5. A tuft backing for tufted carpets comprising the textile composite material according to claim 1.

6. A tuft backing for tufted carpets comprising the textile composite material according to claim 3.

* * * * *